US006539170B2

(12) United States Patent
Shih-Ying

(10) Patent No.: US 6,539,170 B2
(45) Date of Patent: Mar. 25, 2003

(54) KIND OF ECONOMICAL HOUSEHOLD VENTILATOR

(76) Inventor: Huang Shih-Ying, 518108 $4^{th}$ Industrial zone, Shiyan town, Baoan district, Shenzhen (CN)

( * ) Notice: Subject to any disclaimer, the term of this patent is extended or adjusted under 35 U.S.C. 154(b) by 0 days.

(21) Appl. No.: 09/854,396

(22) Filed: May 11, 2001

(65) Prior Publication Data

US 2001/0053666 A1 Dec. 20, 2001

(30) Foreign Application Priority Data

Dec. 5, 2000 (CN) ..... 00233729 U

(51) Int. Cl.[7] ..... F24H 3/02
(52) U.S. Cl. ..... 392/367
(58) Field of Search ..... 392/365, 367, 392/368; 454/233

(56) References Cited

U.S. PATENT DOCUMENTS 1,798,290 A * 3/1931 Winner et al.
2,232,492 A * 2/1941 Steingruber
2,310,843 A * 2/1943 Ditzler
2,469,149 A * 5/1949 Blackwelder
4,103,146 A * 7/1978 Rampe
4,384,189 A * 5/1983 Dahan

* cited by examiner

*Primary Examiner*—Harold Joyce
(74) *Attorney, Agent, or Firm*—Lackenbach Siegel LLP

(57) ABSTRACT

A kind of economical household ventilator consists of the housing and blower. On the housing there are air inlets and exits. There are several air exits with different directions distributed all over the housing. The air inlets are located on the top or/and bottom of the housing respectively. There are air brattices arranged in air exits which can be used for adjusting the air directions or the air exits can be fixed with air brattices for adjusting the air directions. Inside the machine or each air exit, an electrical heating part can be arranged allowing air flowing through so that it can supply warm air or conduct ventilation for general purpose depending on the requirements.

2 Claims, 1 Drawing Sheet

KIND OF ECONOMICAL HOUSEHOLD VENTILATOR

FIELD OF THE INVENTION

The present invention relates to the household ventilating appliances. More particularly, the present invention relates to the economical household ventilator.

BACKGROUND OF THE INVENTION

Normally a family uses electric fan for air circulation. The traditional family uses heater, including housing and fan. The housing has air inlet and outlet, and the heater is equipped with electric heating element. After the fan sucks the cold air, the cold air is forced to flow through the electric heating element and flow out from the outlet after being heated, thus increasing the ambient temperature.

The electric fan has high wind volume, but the swinging direction is limited. The heater can increase the ambient temperature, but like the fan, it has high wind volume of single direction and involves limited direction. The shortcomings of the ordinary fan and ordinary heater are: high volume, people will feel uncomfortable under such air flow; monotonous wind direction, which can't satisfy more places requiring wind and this is uneconomical. For example, when several people are playing at one table, they need to get direct cold air or warm air at the same time. In this case, people can only add the appliance quantity supplying air, but normally there is no such condition. With the improvement of the people's living standard, their requirement is improved, so such traditional household ventilating appliances need improvement.

SUMMARY OF THE INVENTION

The purpose of the invention is to provide a kind of economical cold air or warm air ventilator that is suitable for four seasons, convenient and applicable for various occasions. Such ventilators are suitable for more particular occasion, enabling more people to get relatively traces of cold or warm air simultaneously. This has better usage economical efficiency than the ordinary cold and warm ventilators.

The purpose of further invention of the economical ventilator is to provide one type of ventilator suitable for putting under the table, eliminating the odor and smoke and making the feet of several people enjoy appropriate cold or warm air.

Thus, in accomplishing the foregoing objects, the technical solution of the ventilator is as follows:

The household economical ventilator includes the housing and fan that traditional ventilator has. The housing has air inlet and outlet and there are several split air outlets at each side of the housing.

The ventilator further includes air outlets located surrounding the housing. The air inlet is installed on the top or bottom of the housing.

The ventilator further includes the wind curtain that is located at the air outlet and can adjust the wind outlet direction.

The ventilator further includes an electric heating element that is installed inside the unit or each air outlet and can have air flow through, providing the warm air.

EXAMPLE

Figure 1:
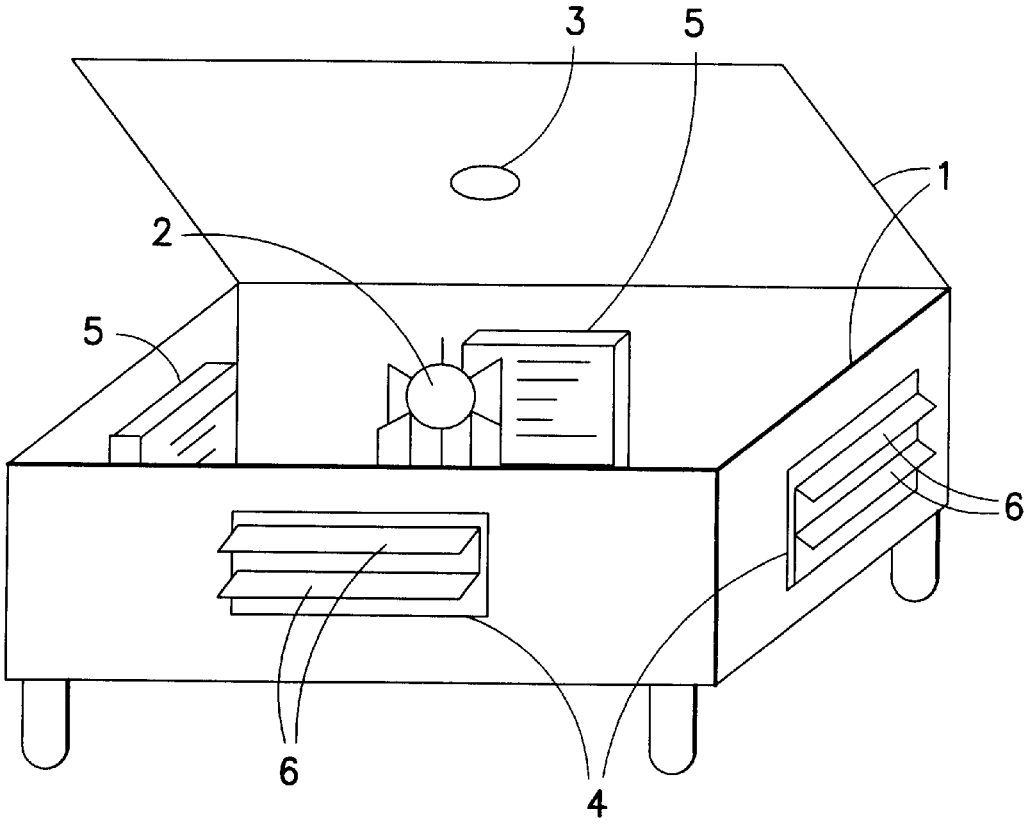
FIG. 1 shows the schematic elevation drawing of this practical new type of ventilator.

In this figure, 1 is housing component, 2 is small fan, 3 is air inlet, 4 is air outlet and 6 is wind curtain that can adjust the air flow direction. The air is sucked in from the air inlet 3 by small fan 2 and is split to send out through various air outlets so that each outlet gets the appropriate wind volume from various directions. When warm air is needed, electric heating element 5 is installed, making the wind flow through the element 5 and flow out of the air outlet after heating. There are many kinds of products available for electric heating element. If the switch of such element of the ventilator, which had electric heating element 5, is turned off, then it can realize ordinary ventilation.

The advantage of the ventilator is: The ventilator that includes electric heating element 5 can get warm air from various directions. In addition, when turning off the electric element switch, it can realize ordinary ventilation from various directions. One unit can be used for several purposes and suitable for all seasons. When there are many people sitting around a table, everybody can get the appropriate cold or warm air, starting from the bottom of the foot upwards. This not only makes people feel more comfortable, but also have better economical efficiency than ordinary fan and ordinary heater. Meanwhile, it can remove the fume of the smoke.

This practical new type is modified based on the existing household ventilator that has bad utilization efficiency and bad comfort characteristic by the people receiving air flow. It has successfully provided a kind of household ventilating appliance suitable for all seasons and has additional exhausting fume effect. It economical application is obvious.

What is claimed is:

1. An economical household ventilator comprising a housing having four sides, a top and a bottom, each side comprising an air outlet, said outlets being radially disposed a 90°, said top comprising an air inlet, a fan disposed below the air inlet, each outlet comprising adjustable louvers, and further comprising a separate heating element disposed at each outlet, said fan, heating elements and louvers being disposed in a common plane, whereby the fan draws air through the air inlet and distributes the air to each of the four louvered outlets, and whereby the air distributed to each respective outlet is heated by the respective heating element at the respective outlet.

2. An economical household ventilator comprising a housing having four sides, a top and a bottom, each side comprising an air outlet, said outlets being.radially disposed a 90°, said top comprising a top inlet, said top inlet comprising a circular grate, a fan disposed below the top inlet, each outlet comprising adjustable louvers, and further comprising a separate heating element disposed at each outlet; said fan, heating elements and louvers being disposed in a common plane, whereby the fan draws air through the top inlet and distributes the air to each of the four louvered outlets, and whereby the air distributed to each respective outlet is heated by the respective heating element at the respective outlet.

* * * * *